US005891611A

United States Patent [19]

Majumdar et al.

[11] Patent Number: 5,891,611

[45] Date of Patent: Apr. 6, 1999

[54] CLAY CONTAINING ANTISTATIC LAYER FOR PHOTOGRAPHIC PAPER

[75] Inventors: Debasis Majumdar, Rochester; Sharon M. Melpolder, Hilton; Charles C. Anderson, Penfield; Paul A. Christian, Pittsford; Thomas N. Blanton, Rochester, all of N.Y.

[73] Assignee: Eastman Kodak Company, Rochester, N.Y.

[21] Appl. No.: 937,685

[22] Filed: Sep. 29, 1997

[51] Int. Cl.[6] ..... G03C 1/79; G03C 1/89

[52] U.S. Cl. ..... 430/529; 430/527; 430/531; 430/536; 430/538; 428/451; 428/454

[58] Field of Search ..... 430/527, 529, 430/531, 538, 536; 428/451, 454

[56] References Cited

U.S. PATENT DOCUMENTS

| | | | |
|---|---|---|---|
| 3,525,621 | 8/1970 | Miller | 430/527 |
| 4,173,480 | 11/1979 | Woodward | 430/527 |
| 5,244,728 | 9/1993 | Bowman et al. | 430/527 |
| 5,478,709 | 12/1995 | Vandenabeele | 430/527 |
| 5,554,670 | 9/1996 | Giannelis et al. | 523/209 |

OTHER PUBLICATIONS

T. Lan, "Mechanism of Clay Tactoid Exfoliation in Epoxy—Clay Nanocomposites", Chem. Mater., 1995, 7, 2144–2150.
Research Disclosure 36544, Sep. 1994, pp. 501–541.
Research Disclosure 38957, Sep. 1996, pp. 591–639
Research Disclosure 37038, Feb. 1995, pp. 79–116.

*Primary Examiner*—Richard L. Schilling
*Attorney, Agent, or Firm*—Carl F. Ruoff

[57] ABSTRACT

The present invention is a photographic paper which includes a paper sheet with a polyolefin resin layer on each surface of the paper sheet. The photographic paper includes a print retaining antistatic layer having a dry coverage of from 80 mg/m$^2$ to 1000 mg/m$^2$ on one of the free surfaces of the polyolefin layers. The print retaining antistatic layer includes a smectite clay, and a polymeric binder wherein the polymeric binder can sufficiently intercalate inside or exfoliate the smectite clay. The photographic paper can include a silver halide light sensitive emulsion layer on the other free surface.

18 Claims, 1 Drawing Sheet

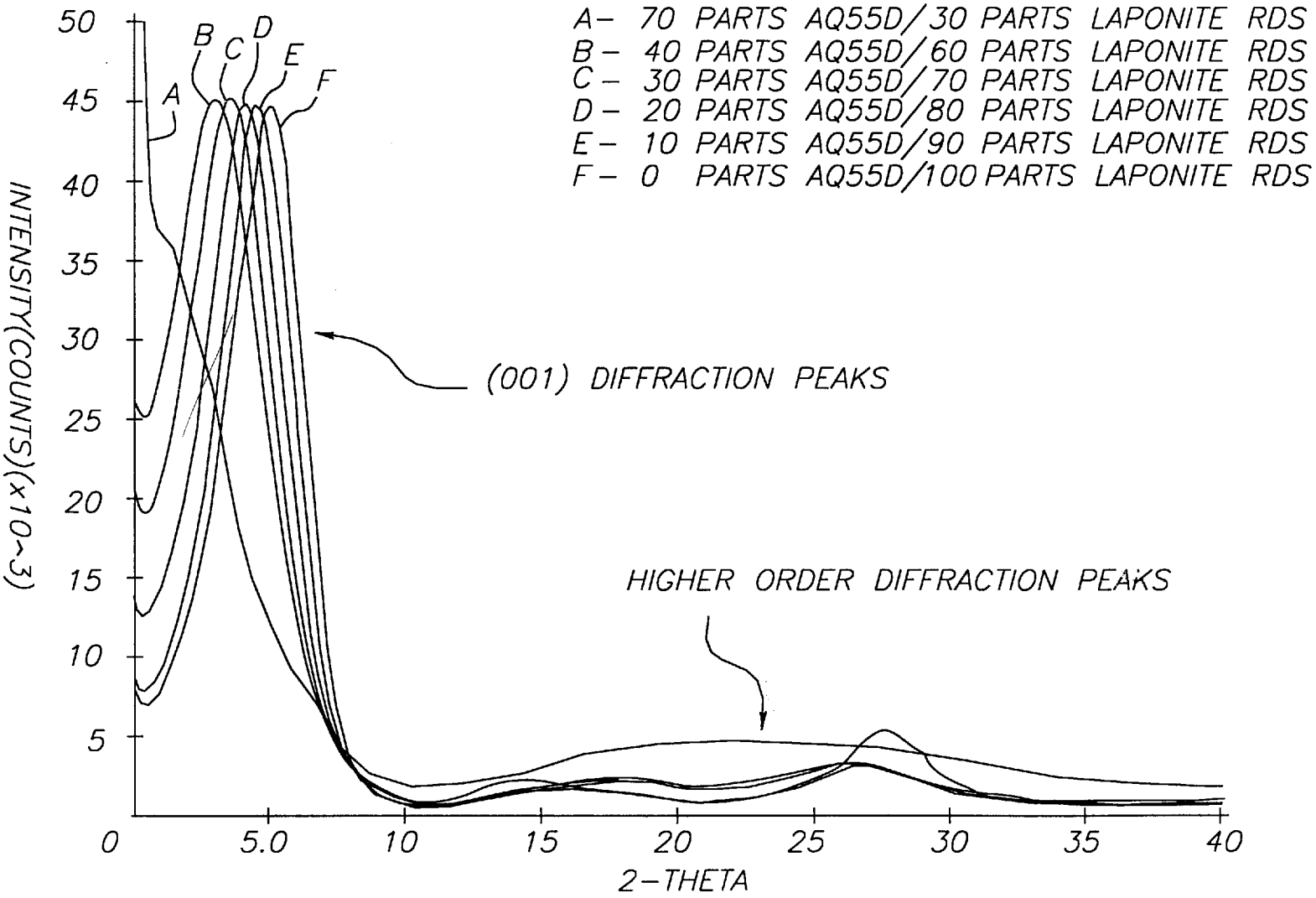
A– 70 PARTS AQ55D/ 30 PARTS LAPONITE RDS
B– 40 PARTS AQ55D/ 60 PARTS LAPONITE RDS
C– 30 PARTS AQ55D/ 70 PARTS LAPONITE RDS
D– 20 PARTS AQ55D/ 80 PARTS LAPONITE RDS
E– 10 PARTS AQ55D/ 90 PARTS LAPONITE RDS
F– 0 PARTS AQ55D/100 PARTS LAPONITE RDS
(001) DIFFRACTION PEAKS
HIGHER ORDER DIFFRACTION PEAKS
A
B
C
D
E
F
INTENSITY(COUNTS)(x10^3)
50
45
40
35
30
25
20
15
10
5
0
5.0
10
15
20
25
30
35
40
2–THETA

CLAY CONTAINING ANTISTATIC LAYER FOR PHOTOGRAPHIC PAPER

CROSS REFERENCE TO RELATED APPLICATIONS

This application relates to commonly assigned copending application Ser. No. 08/939,515, filed simultaneously herewith and hereby incorporated by reference for all that it discloses. This application relates to commonly assigned copending application Ser. No. 08/940,860, filed simultaneously herewith and hereby incorporated by reference for all that it discloses.

FIELD OF THE INVENTION

This invention relates to antistatic backing layers on an imaging element containing paper support, specifically photographic paper, with print or backmark retaining qualities, spliceability, minimized track off characteristics and to coating compositions suitable for its preparation. Particularly, this invention relates to polyolefin coated photographic paper supports having on one side thereof an antistatic coating of a layer capable of (i) receiving and retaining various types of marking including, printing ink and the like, (ii) being joined through heat splicing and (iii) being conveyed through roller/nip transport machines with minimal track off.

BACKGROUND OF THE INVENTION

It is known that hydrophobic resin sheet and web materials of low surface conductivity readily become electrostatically charged due to friction with dielectric materials and triboelectrically chargeable transport means, such as, rollers. The electrostatic charging is particularly severe in relatively dry environments and at high speeds of conveyance. An electrostatically charged web can result in static discharge through generation of sparks which poses fire hazards in the presence of flammable solvents at a typical coating site. For a web containing an unprocessed photographic recording element, sparking can cause additional problems, such as, developable fog and degradation of the image quality. So, it is very important to provide antistatic protection on photographic films and paper.

For photographic paper, an additional criterion is the ability of the antistatic backing layer to receive printing (e.g., bar codes or other indicia containing useful information) typically administered by dot matrix or inkjet printers and to retain these prints or markings as the paper undergoes processing (viz, backmark retention).

From U.S. Pat. No. 3,525,621, it is known that antistatic properties can be given to an aqueous coating composition by practically any silica sol, but preferably silica particles of large surface area of the order of 200–235 $m^2/g$ in combination with an alkylaryl polyether sulphonate. However, the high solubility of the alkylaryl polyether sulphonate in aqueous medium will cause leaching during processing resulting in poor backmark retention.

Antistatic layers on the basis of solely colloidal silica usually show microcracks upon drying which can lower the lateral conductivity. Additionally calcium stearate from the paper base often leaches out through these cracks causing stearate sludge in the processing tanks, requiring costly clean up operations.

U.S. Pat. No. 4,173,480 teaches the use of synthetic hectorite as antistatic additive to a silica containing layer. However, the hydrophilicity of the hectorite results in poor backmark retention upon exposure to processing solutions. In fact, the experience in the trade is most colloidal silica based antistatic backings without a polymeric binder provide poor post-processing backmark retention qualities for photographic paper.

U.S. Pat. No. 5,244,728 discloses backing formulations containing alumina modified colloidal silica and an antistatic agent in a polymeric binder consisting of an addition product of alkyl methacrylate, alkali metal salt and vinyl benzene. Although such backing layers provide adequate antistatic protection and backmark retention characteristics, these layers lack sufficient mechanical integrity as manifested in poor spliceability and track off characteristics. Heat splicing of photographic paper rolls is often carried out during printing operations and is expected to provide enough mechanical strength to resist peeling as the web goes through automatic photographic processing. Poor splice strength can cause a number of problems including jamming of automatic processing equipment. Track off during conveyance can lead to undesirable build-up of materials on conveyance rollers and other surfaces often causing product defects.

An object of the present invention is to provide an antistatic backing layer on an imaging element containing paper support, specifically photographic paper, with backmark receiving and retention qualities, heat spliceability and good trackoff characteristics.

While the invention herein finds particular use in the photofinishing industry to print barcodes or other indicia on the back of paper prints by using dot matrix printers for example, it is useful and suitable for applying print or ink markings to any surface wherein the original surface does not possess the desired characteristics. The application with regard to photofinishing has a particularly stringent requirement because the backing layer must survive photographic processing through the automatic processing devices having the harshest conditions in order to be useful.

In photofinishing applications, the coating compositions must satisfy the following requirements:

1. The ingredients must be compatible. This is a particularly stringent requirement when antistatic agents are formulated in the coating composition so that the print retaining layers also possess antistatic properties. The polymeric binder in the coating composition in the form of a latex can be easily destabilized causing agglomeration of the latex particles to occur.

2. The coatings must be alkali resistant up to a pH of 10 to survive the photographic processing solutions.

3. The coatings must be resistant to discoloration due to processing solutions and/or aging.

4. The coatings must be able to receive and retain ink or other marking materials through the photographic processing.

5. The coatings must not be photoactive and interfere with the light sensitive portions of the photographic paper.

6. The coatings must have resistivity less than 12 log ohms per square at 50% RH.

7. The backside coating must be spliceable to the frontside in commercially available splicing devices and maintain sufficient peel strength.

8. The coatings must be resistant to track off during conveyance by various roller/nip transport machines during manufacturing of the photographic paper and also in the development processor.

9. The coatings must be block resistant in the rolled form. That is, in preparation of printing paper for use in photographic applications, the paper in processing is rolled upon itself. It is necessary that the backmark retaining layer does not block or ferrotype together with the opposite surface of the paper support.

10. The coatings must have a stability of from 6 to 12 months in order to be commercially acceptable.

The coatings and the coating compositions according to this invention satisfy these requirements by utilizing in combination an electrically conducting synthetic smectite clay and a polymeric binder.

SUMMARY OF THE INVENTION

The present invention is a photographic paper which includes a paper sheet with a polyolefin resin layer on each surface of the paper sheet. The photographic paper includes a print retaining antistatic layer having a dry coverage of from 10 mg/m$^2$ to 10000 mg/m$^2$ on one of the free surfaces of the polyolefin layers. The print retaining antistatic layer includes a smectite clay, and a polymeric binder wherein the polymeric binder can sufficiently intercalate inside or exfoliate the smectite clay.

The photographic paper can include a silver halide light sensitive emulsion layer on the other free surface.

BRIEF DESCRIPTION OF THE DRAWINGS

FIG. 1 shows the x-ray diffraction pattern of clay and polymer for different clay to polymer weight ratios.

For a better understanding of the present invention, together with other objects, advantages and capabilities thereof, reference is made to the following description and claims in connection with the above-described drawing.

DETAILED DESCRIPTION OF THE PREFERRED EMBODIMENTS

This invention provides a photographic paper coated with a polyolefin resin layer on each surface, one of the free surfaces of one of the polyolefin layers bearing a print retaining antistatic layer with improved spliceability and track off characteristics. The print retaining antistatic layer includes a clay which is a layered hydrous magnesium silicate, and a polymeric binder wherein the polymeric binder is capable of sufficiently intercalating inside and/or exfoliating the layered hydrous magnesium silicate.

When a photographic paper containing a polyolefin layer on either side thereof is to be coated with a coating composition to impart ink retention to the surface, antistatic characteristics, spliceability, and track off resistance, in accordance with this invention it is preferred that the polyolefin layer be corona discharge treated. While different photosensitive elements may require different coverages, the current invention can be applied to both color and black and white photosensitive papers with adjusted coverage values depending on the particular application. The layers prepared in accordance with this invention exhibit resistivities less than 12 log ohms/square at 50% relative humidity and preferably from about 9 to 11 log ohms/square.

The clay material (component A) used in this invention is an electrically conducting smectite clay which closely resembles the natural clay mineral hectorite in both structure and composition. Hectorite is a natural swelling clay which is relatively rare and occurs contaminated with other minerals such as quartz which are difficult and expensive to remove. Synthetic smectite clay is free from natural impurities, prepared under controlled conditions. One such synthetic smectite clay is commercially marketed under the tradename Laponite by Laporte Industries, Ltd of UK through its US subsidiary, Southern Clay Products, Inc. It is a layered hydrous magnesium silicate, in which magnesium ions, partially replaced by suitable monovalent ions such as lithium, sodium, potassium and/or vacancies, are octahedrally coordinated to oxygen and/or hydroxyl ions, some of which may be replaced by fluorine ions, forming the central octahedral sheet; such an octahedral sheet is sandwiched between two tetrahedral sheets of silicon ions, tetrahedrally coordinated to oxygen.

There are many grades of Laponite such as RD, RDS, J, S, etc. each with unique characteristics and can be used for the present invention, as long as they maintain their electrical conductivity. Some of these products contain a polyphosphate peptising agent such as tetrasodium pyrophosphate for rapid dispersion capability; alternatively, a suitable peptiser can be incorporated into Laponite later on for the same purpose. A typical chemical analysis of Laponite RDS and its physical properties, as per Laponite Product Bulletin, are provided below.

TABLE 1

Typical Chemical Analysis

| Component | Weight % |
|---|---|
| $SiO_2$ | 54.5 |
| MgO | 26.0 |
| $Li_2O$ | 0.8 |
| $Na_2O$ | 5.6 |
| $P_2O_5$ | 4.1 |
| Loss on ignition | 8.0 |

TABLE 2

Typical Physical Properties

| | |
|---|---|
| Appearance | White Powder |
| Bulk density | 1000 kg/m$^3$ |
| Surface Area | 330 m$^2$/g |
| pH (2% suspension) | 9.7 |
| Sieve analysis, | 98% <250 m |
| Moisture content | 10% |

Laponite separates into tiny platelets of lateral dimension of 25–50 nm and a thickness of 1–5 nm in deionized aqueous dispersions, commonly referred to as "sols." Typical concentration of Laponite in a sol can be 0.1% through 10%. During dispersion in deionized water an electrical double layer forms around the clay platelets resulting in repulsion between them and no structure build up. However, in a formulation containing electrolytes introduced from tap water or other ingredients, the double layer can be reduced resulting in attraction between the platelets forming a "House of Cards" structure.

Dispersion of synthetic clay (component A) in the polymeric binder (component B) plays a critical role in the performance of the antistatic layer. Like any other pigment, the flocculation of the clay phase in the polymeric phase can degrade the mechanical properties of the film. Flocculation of clay can lead to severe dusting and/or post-process reddish discoloration.

The dispersion of clay particles in a polymer matrix can result in the formation of three general types of composite materials as discussed by Lan et al (T. Lan, P. D. Kaviratna and T. J. Pinnavia, Chem. Mater. 7, 2144(1995)). (1) Conventional composites may contain clay with the layers unintercalated in a face-to-face aggregation. Here the clay platelet aggregates are simply dispersed with macroscopic segregation. (2) Intercalated clay composites are intercalation compounds of definite structure formed by the insertion of one or more molecular layers of polymer into the clay host galleries. (3) Finally, exfoliated clay-polymer composites where singular clay platelets are dispersed in a continuous polymer matrix. We discovered that the latter two arrangements of the clay in the polymer matrix provides the desired properties of the antistatic layers.

Intercalation and exfoliation of clay can be conveniently monitored by measuring the basal (001) spacing of the clay platelets using x-ray diffraction technique, as illustrated by Gianellis et al. in U.S. Pat. No. 5,554,670, incorporated herein by reference. With intercalation of a polymer in the clay gallery, an increase in the basal spacing of the clay is observed. When completely exfoliated, the diffraction peaks disappear since the crystallographic order is lost.

For the current invention the polymeric binder (B) can be a water soluble polymer (e.g., polyvinyl alcohol, polyethylene oxide, polystyrene sulfonate, polyacrylamide), a water insoluble latex or dispersion (e.g., polymers and interpolymers of styrene, styrene derivatives, alkyl acrylates or alkyl methacrylates and their derivatives, olefins, acrylonitrile, polyurethane and polyester ionomers). The latex polymers are of particular importance because of their widespread use in imaging elements such as photographic paper.

A crosslinking agent can be optionally incorporated in the coating formulation, particularly for water soluble polymers, to provide improved film integrity during processing.

X-ray Diffraction Studies of Intercalation inside or Exfoliation of Smectite Clay The following are examples of intercalation or exfoliation of clay (component A) by various polymeric binders (B).

Polyesterionomers

The term polyesterionomer refers to polyesters that contain at least one ionic moiety. Such ionic moieties function to make the polymer water dispersible. Examples of this class of polymers include Eastman AQ polyesterionomers manufactured by Eastman Chemical Co. The AQ polymers are well suited for a variety of applications, such as dispersion, adhesion, bonding, coating, priming, etc. These polymers are relatively high molecular weight amorphous polyesters. Upon drying, they form hard clear films adherent to a variety of substrates and resistant to water, blocking and rubbing.

A particular polymer used in this work is Eastman AQ55D with a glass transition temperature of 55° C. The following Table lists the (001) spacing of Laponite RDS clay when mixed with varying amounts of AQ55D. It is clear that the incorporation of increasing amount of AQ55D in the mixture increases the (001) spacing of clay indicating intercalation of the polymer in the clay gallery, leading to eventual exfoliation of clay for a 30/70 clay/binder ratio. The x-ray diffraction patterns are shown in FIG. 1. The shift in the main (001) peak towards lower 2-theta diffraction angles with increasing amount of AQ55D illustrates the increase in basal plane spacing. This increase in basal plane spacing together with increased peak width, broader and less defined higher order peaks represent intercalation of AQ55D in the clay structure (Curves B through F). Finally, complete loss of intensity of the (001) peaks particularly the higher order peaks for a 30/70 clay/binder ratio indicates exfoliation of the clay in the polymer matrix (Curve A).

| Latex | weight % of Laponite RDS | weight % of latex | Basal plane (001) spacing, Angstroms |
|---|---|---|---|
| | 100 | 0 | 13.4 |
| AQ55D | 90 | 10 | 14.2 |
| AQ55D | 80 | 20 | 15.5 |
| AQ55D | 70 | 30 | 16.9 |
| AQ55D | 60 | 40 | 18.5 |
| AQ55D | 30 | 70 | exfoliation |

Acrylonitriles

Two commercially available acrylonitrile-containing latex polymers were chosen, for this purpose. These are supplied by BF Goodrich as Hycar 1570X75 and Hycar 1572X64. As indicated in the following Table for a 30/70 clay/latex mixture, both the aforementioned latex materials caused exfoliation of the clay.

| Latex | weight % of Laponite RDS | weight % of latex | Basal plane (001) spacing, Angstroms |
|---|---|---|---|
| Hycar 1570X75 | 30 | 70 | exfoliation |
| Hycar 1572X64 | 30 | 70 | exfoliation |

Polyurethanes

Two commercially available aqueous dispersions of anionic aliphatic polyurethanes were chosen for this purpose. One was Witcobond 232 supplied by Witco Corporation. The other was Bayhydrol PR 240 supplied by Bayer. As shown in the following Table, the basal plane spacing of Laponite RDS increased by 6.8 Angstroms or 51 percent when the clay/latex ratio is changed from 100/0 to 30/70 with Bayhydrol PR 240 as the binder. In comparison, the same basal plane spacing of Laponite RDS increased by 3.1 Angstroms or 23 percent when the clay/latex ratio is changed from 100/0 to 30/70 with Witco 232 as the binder. It is obvious that for a 30/70 clay/binder ratio, Bayhydrol PR 240 had more intercalation inside the clay lattice than Witco 232.

| Polyurethane | weight % of Laponite RDS | weight % of latex | Basal plane (001) spacing, Angstroms |
|---|---|---|---|
| Bayhydrol PR240 | 30 | 70 | 20.2 |
| Witco 232 | 30 | 70 | 16.5 |
| | 100 | 0 | 13.4 |

Water Soluble Polymers

Gelatin as a hydrophilic colloid was used as a binder for clay. As shown in the following Table, for a 30/70 clay/binder ratio, gelatin caused exfoliation of the clay.

| Polymer | weight % of Laponite RDS | weight % of colloid | Basal plane (001) spacing, Angstroms |
|---|---|---|---|
| gelatin | 30 | 70 | exfoliation |

A sulfonated styrene/maleic anhydride copolymer, commercially supplied as Versa TL3 by National Starch and Chemical Company was used as a binder. As shown in the following Table, for a 30/70 clay/binder ratio, Versa TL3 caused exfoliation of the clay.

| Polymer | weight % of Laponite RDS | weight % of polymer | Basal plane (001) spacing, Angstroms |
|---|---|---|---|
| Versa TL3 | 30 | 70 | exfoliation |

It was discovered that antistatic layers comprising one or more polymeric binder(s) (component B) selected from the group consisting of the poly vinyl alcohols, poly ethylene oxides, polyacrylamides, polystyrene sulfonates, polymers of styrene, polymers of styrene derivatives, interpolymers of styrene, interpolymers of styrene derivatives, alkyl acrylates, alkyl methacrylates, derivatives of alkyl acrylates, derivatives of alkyl methacrylates, olefins, acrylonitriles, polyurethanes and polyester ionomers which can "sufficiently" intercalate inside and/or exfoliate the clay (component A), provide the necessary characteristics, as described earlier, to the photographic paper when coated by conventional coating techniques. Polymeric binders which can "sufficiently" intercalate inside the clay are defined to be those which can increase the basal plane spacing of the clay by 50 percent or more, when the clay/binder weight ratio is changed from 100/0 to 30/70.

The coating composition may be applied to the web with or without a defoaming agent and/or surfactant, depending on the method of application. These when used must be compatible with the latex-binder and must not cause destabilization or agglomeration. In some formulation where a cross-linkable polymer is chosen as a binder, a suitable cross-linking agent may be incorporated to impart additional mechanical strength to the coating.

When a photographic paper containing a polyolefin layer on either side thereof is to be coated in accordance with this invention with a composition to impart ink retention to the surface, antistatic characteristics, spliceability, and pick off resistance, it is preferred that the polyolefin layer be corona discharge treated. The composition is coated by any conventional method for coating aqueous solutions, such as direct or offset gravure, hopper coating, curtain coating, bead coating, air/knife coating and dried at temperatures between 90° and 170° F. While different photographic elements may require different coverages, the current invention can be applied to both color and black and white photographic papers with adjusted coverage values depending on the particular application. The layers prepared in accordance with this invention exhibit resistivities less than 12 log ohms/square at 50% relative humidity and preferably from about 9 to 11 log ohms/square. The various attributes of the current invention are illustrated through many examples.

The relative proportion of the conducting synthetic clay (component A) can vary from 20–95 weight % in the dry coating; the relative proportion of the polymeric binder (component B) can vary from 80-5 weight %. In a preferred embodiment of this invention the amount of clay should be 50–80 weight % of the dry film and the rest the polymeric binder. The coating composition is coated at a coverage of between 10 mg/m$^2$ and 10000 mg/m$^2$, preferably between 300–600 mg/m$^2$.

Whenever a cross linking agent is added, its amount is varied between 1–20 weight % of the polymeric binder, preferably between 5–15 weight %.

Polymeric binders which can "sufficiently" intercalate inside the clay are defined to be those which can increase the basal plane spacing of the said clay by 50 percent or more, when the clay/binder weight ratio is changed from 100/0 to 30/70. It was observed that binders which do not sufficiently intercalate inside or exfoliate the smectite clay may lead to inferior characteristics, when used in an antistatic layer on the support. The inferior characteristics may be in terms of poorer conductivity, dusting, and/or reddish coloration upon processing of the support.

The present invention also encompasses a three component antistatic layer which includes component A which is a conducting smectite clay, component B which is one or more additive(s) or binder(s) selected from the group consisting of the poly vinyl alcohols, poly ethylene oxides, polyacrylamides, polystyrene sulfonates, hydrophilic colloids, polymers of styrene, polymers of styrene derivatives, interpolymers of styrene, interpolymers of styrene derivatives, alkyl acrylates, alkyl methacrylates, derivatives of alkyl acrylates, derivatives of alkyl methacrylates, olefins, acrylonitriles, polyurethanes and polyester ionomers which can sufficiently intercalate inside and/or exfoliate the conducting smectite clay, and component C which can be one or more film forming polymeric binders which do not sufficiently intercalate inside or exfoliate the conducting smectite clay. The antistatic layer can include a cross linking agent to further improve the properties of the antistatic layer as well as other optional additives.

The aforementioned aspect of the current invention teaches of a three component system. Polymeric binders which do not intercalate or exfoliate the layered hydrous magnesium silicate can still be incorporated in a functional antistatic layer, through the use of the additive or polymeric binder listed previously which can sufficiently intercalate inside and/or exfoliate the conducting smectite clay. This will allow a formulator to choose from a wider selection of polymeric binders with attractive properties.

The polymeric additive as component (B) capable of intercalating inside or exfoliating the conducting smectite clay (Component A) has been listed previously. The relative amount of this component (B) can vary between 1–80 weight % of the conducting smectite clay but is typically around 1–20%. The materials chosen as component (B) to illustrate the current invention are a polyester ionomer commercially supplied as AQ55D by Eastman Chemicals and a sulfonated styrene/maleic anhydride copolymer, commercially supplied as Versa TL3 by National Starch and Chemical Company. Both polymers can exfoliate the Laponite clay for a clay/polymer ratio of 30/70.

The polymeric binder chosen as component C to illustrate the current invention is a commercially available aliphatic polyurethane supplied by Witco Corporation, which has good film-forming, scratch and abrasion resistance properties together with high toughness and can improve the physical performance of the antistatic layer. However, as shown before by x-ray diffraction results, Witcobond 232 is not capable of sufficiently intercalating inside or exfoliating Laponite RDS. The basal plane spacing of Laponite RDS increased by (16.5-13.4) 23 percent, when the clay/binder ratio is changed from 100/0 to 30/70.

Thus, a simple two component system of Laponite RDS (Component A) and Witcobond 232 (Component B) is not expected to provide desirable results, as per the teachings of the present invention. However, the present invention teaches that a three component system comprising Laponite RDS (component A), an additive such as AQ55D (Component B) and Witcobond 232 (Component C) can provide an antistatic layer with desirable properties, as illustrated by the following examples.

In a particularly preferred embodiment, the photographic paper includes an image-forming layer which is a radiationsensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a photographic paper bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the photographic elements of the present invention can contain one or more auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. Details regarding supports and other layers of the photographic elements of this invention are contained in Research Disclosure Item 38957, September 1996, Research Disclosure, Item 36544, September, 1994 and Research Disclosure, Item 37038, February 1995 incorporated herein by reference.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure Item 38957, September 1996 and Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

SAMPLE PREPARATION

Corona-discharge treated polyolefin coated photographic paper was used as the web on which aqueous coatings were applied through hopper coating and dried at 180° F. The coating coverage varied between 100 mg/m$^2$ and 600 mg/m$^2$ when dried. The samples were evaluated for surface resistivity, backmark retention, splice strength and track off.

TEST METHODS

Surface Resistivity Test

This test measures the surface resistivity of photographic papers. Samples are preconditioned at 50% RH 72° F. for at least 24 hours prior to testing. Surface electrical resistivity (SER) is measured with a Keithly Model 616 digital electrometer using a two point DC probe by a method similar to that described in U.S. Pat. No. 2,801,191.

Backmark Retention Test

A printed image was applied onto the coated papers prepared as above using a pre-process ribbon print. The paper was then subjected to a conventional developer for 30 seconds, washed with warm water for 5 seconds and rubbed for print retention evaluation. The following ratings are assigned, with numbers 1–3 indicating acceptable performance.

1=Outstanding, very little difference between processed and unprocessed appearance.

2=Excellent, slight degradation of appearance

3=Acceptable, medium degradation of appearance

4=Unacceptable, serious degradation of appearance

5=Unacceptable, total degradation.

Splice Strength Measurement

The backside of a strip of photographic paper containing the coating of interest is placed with 6–8 mm of overlap on the photographic element containing side of a similar strip of photographic paper and heated in a custom made set up for 4 seconds under 40 psi of pressure, replicating the conditions used by commercially available equipment used for heat splicing of photographic paper. The strength of the resultant splice is determined in an Instron machine as the force (measured in grams) necessary to peel the two strips apart, using a crosshead speed of 50 mm/min.

Track Off Test

A loop is formed of a strip of photographic paper containing the coating of interest on its backside and is run for 15 minutes in a custom made set up over a number of rollers, including one with a soft, tacky surface and a stationary shoe, also with a soft, tacky surface. The set up is designed to simulate the conveyance of photographic web in a commercial printer. The surface of the tacky roller and the shoe in contact with the test coating is visually inspected for debris after the run and the number of specs accumulated at the shoe are counted as a measure of track off. The tests are done at 80% RH and 72° F., after preconditioning the sample at the same conditions for 12 hours, in order to maximize the generation of track off debris.

EXAMPLES

The current invention is further illustrated through the following examples.

Example 1

Samples 1–4 were coated as per the current invention using Laponite RDS as component A and AQ55D, a polyester ionomer, as component B. Sample 5 was coated as per a disclosure in Table II of (column 5) of U.S. Pat. No. 5,244,728. The details about these coatings and the test results are listed in Table 1. It is clear that samples 1–4 prepared as per the current invention exhibit good SER, backmark retention, splice strength and trackoff characteristics desired of photographic paper. In fact these samples have properties either comparable to or better than those of sample 5 prepared as per U.S. Pat. No. 5,244,728.

Laponite RDS (smectite clay) in a polyester ionomer binder

| SAMPLE | Laponite:AQ55D | coverage mg/m$^2$ | SER log Ω/□ | Backmark retention | splice strength peel force,g | Trackoff |
|---|---|---|---|---|---|---|
| 1 | 60:40 | 600 | 10.3 | 1 | 130.3 | few specs/ v.little pickoff |
| 2 | " | 400 | 10.6 | 1 | 122.7 | 2 specs/ clean |
| 3 | 70:30 | 600 | 9.5 | 2 | 181.9 | 2 specs/ clean |
| 4 | " | 400 | 10.0 | 2 | 138.3 | light track off/cl |
| 5 As per U.S. Pat. No. 5,244,728 | | 450 | 10 | 1 | 24 | heavy pickoff/ heavy white dusting, many dark specs.. |

Example 2

Samples 6–9 were prepared as per the current invention using Laponite RDS as component A and Hycar 1570X75 supplied by BF Goodrich as component B. Samples 6–9 also contained a small amount (15 weight percent of Hycar1570X75) of a crosslinking agent. Samples 10–13 were prepared as per the current invention using Laponite RDS as component A and Hycar 1572X64 supplied by BF Goodrich as component B. The details about these coatings and the test results are listed in Table 2. It is clear that samples 6–13 prepared as per the current invention exhibit good SER, backmark retention, splice strength and trackoff characteristics desired of photographic paper.

Laponite RDS (smectite clay) in acrylonitrile binders.

| SAMPLE | Laponite: Hycar 1570X75 | coverage mg/m$^2$ | SER log Ω/□ | Backmark retention | splice strength peel force,g | Trackoff |
|---|---|---|---|---|---|---|
| 6 | 40:60 | 300 | 10.5 | | | clean/clean |
| 7 | 50:50 | 300 | 9.9 | 2 | 83 | |
| 8 | 60:40 | 300 | 9.7 | 3 | 63 | sl.pickoff/ clean |
| 9 | 70:30 | 300 | 9.1 | 3 | 61 | |

| SAMPLE | Laponite:Hycar 1572X64 | coverage mg/m$^2$ | SER log Ω/□ | Backmark retention | splice strength peel force,g | Trackoff |
|---|---|---|---|---|---|---|
| 10 | 40:60 | 300 | 11.4 | 2 | | |
| 11 | 50:50 | 300 | 10.8 | 2 | 72 | sl.dusting/ sl.pickoff |
| 12 | 60:40 | 300 | 9.9 | 2 | 87 | |
| 13 | 70:30 | 300 | 9.7 | 2 | 102 | sl.pickoff/ clean |

Example 3

Samples 14–17 were prepared as per the current invention, using Laponite RDS as component A and Bayhydrol PR 240, a sulfonated polyurethane version supplied by Bayer, as component B. X-ray diffraction results indicated Bayhydrol PR 240 can sufficiently intercalate inside the smectite clay lattice.

The details about these coatings and the test results are listed in Table 3. Clearly, the test results indicate superior performance of samples 14–17. Samples 14–17 containing Bayhydrol PR 240 exhibit good conductivity, backmark retention, splice strength and trackoff characteristics desired of photographic paper.

| SAMPLE | Laponite: Bayhydrol PR240 | coverage mg/m$^2$ | SER log Ω/□ | Backmark retention | splice strength peel force,g | Trackoff |
|---|---|---|---|---|---|---|
| 14 | 60:40 | 600 | 10.4 | 2 | 165 | 2 specs/ clean |
| 15 | " | 400 | 10.3 | 1 | | |
| 16 | 70:30 | 600 | 9.4 | 3 | 219 | clean/clean |
| 17 | " | 400 | 9.5 | 3 | | |

COMPARATIVE EXAMPLES

Samples 18 and 19 were made on corona discharge treated resin coated paper for a dry coverage of 400 mg/m$^2$, sample 18 containing 100% Laponite RDS and sample 19 containing Laponite RDS and Ludox AM (colloidal silica, supplied by Du Pont) in a 50/50 ratio, in the dry form. These coatings are as per the teachings of U.S. Pat. No. 4,173,480. Although conducting, both of these coatings provided an unacceptable backmark retention rating of 5, as shown in the following table. It is concluded that synthetic clay alone or in conjunction with just colloidal silica does not provide adequate backmark retention.

| SAMPLE | Laponite: Ludox AM | coverage mg/m$^2$ | SER log Ω/□ | Backmark retention |
|---|---|---|---|---|
| 18 | 100:0 | 400 | 7.4 | 5 |
| 19 | 50:50 | 400 | 8.4 | 5 |

Samples 20–22 were made on corona discharge treated resin coated paper for a dry coverage of 400 mg/m$^2$ using Laponite RDS and a binder such as gelatin, methyl cellulose or starch, as per the suggestion of U.S. Pat. No. 4,173,480. Although conducting, all these coatings provided an unacceptable backmark retention rating of 4 or 5, as shown in the following table, indicating the inferiority of the binders suggested in U.S. Pat. No. 4,173,480.

| SAMPLE | Laponite: binder | binder | coverage mg/m$^2$ | SER log Ω/□ | Backmark retention |
|---|---|---|---|---|---|
| 20 | 70:30 | gelatin | 400 | 9.9 | 4 |
| 21 | 70:30 | methyl cellulose | 400 | 9.3 | 5 |
| 22 | 70:30 | starch | 400 | 9.1 | 4–5 |

COMPARATIVE EXAMPLES

Samples 23 and 24 were prepared using Laponite RDS and Witcobond 232. All samples contained a small amount (15 weight % of the Witcobond 232) of a cross linking agent. X-ray diffraction results indicate that Witcobond 232 cannot sufficiently intercalate inside and/or exfoliate the smectite clay.

The details about the coating and the test results are listed in the following Table. Sample 23 produced reddish coloration upon processing and is clearly unacceptable. Sample 24 on the other hand had a resistivity higher than desirable. These examples illustrate that for a two component system, polymeric binders that cannot sufficiently intercalate inside and/or exfoliate the smectite clay provide poor quality coatings.

| SAMPLE | Laponite: Witco 232 | coverage mg/m$^2$ | SER log Ω/□ | Backmark retention | splice strength peel force,g | Trackoff |
|---|---|---|---|---|---|---|
| 23 | 70:30 | 600 | 10.1 | Reddish coloration | 207 | |
| 24 | 60:40 | 600 | 11.2 | | | |

WORKING EXAMPLES

The following examples illustrate the current invention for a three component system. Samples 25–28 are prepared with an antistatic layer containing Laponite RDS (component A), an additive AQ55 D or Versa TL 3 (component B), and Witcobond 232 (component C). The weight ratio of component B to component A was maintained at about 15%. A small amount (15 weight % of component C) of cross linking agent was also added to each sample to further improve the mechanical properties. As described earlier, AQ55 D and Versa TL 3 (component B) are compounds capable of sufficiently intercalating inside and/or exfoliating the Laponite RDS(component A). On the other hand Witcobond 232 (Component C) cannot sufficiently intercalate inside and/or exfoliate Laponite RDS. The details of the coatings and the test results are listed in the following Table.

Clearly, these antistatic coatings satisfy the various criteria desired of photographic paper. The results regarding, conductivity, backmark retention, splice strength and track off tests obtained from samples 25–28 prepared as per the current invention are better than or are, at least, comparable to those obtained from samples 23 and 24, which did not contain component B, a key component as per the current invention.

This illustrates a key teaching of the present invention, that although a polymeric binder, which does not sufficiently intercalate inside and/or exfoliate the smectite clay, cannot form a desirable antistatic layer in a two component system (with conducting smectite clay), it can form a desirable antistatic layer in a three component system which includes as an additive an additional polymeric or organic compound which can sufficiently intercalate inside and/or exfoliate the smectite clay. This will allow formulators to incorporate binders with attractive properties.

| SAMPLE | Comp. A Laponite wt. % | Comp.B AQ55D wt. % | Comp.C Witco 232 wt. % | coverage mg/m$^2$ | SER log Ω/□ | Backmark retention | splice strength peel force, g | Trackoff |
|---|---|---|---|---|---|---|---|---|
| 25 | 71.4 | 10.7 | 17.9 | 600 | 9.6 | 2 | 182 | clean/ clean |
| 26 | 63.3 | 9.5 | 27.2 | 600 | 10.4 | 1 | 273 | |
| SAMPLE | Comp. A Laponite wt. % | Comp.B VersaTL3 wt. % | Comp.C Witco 232 wt. % | coverage mg/m$^2$ | SER log Ω/□ | Backmark retention | splice strength peel force, g | Trackoff |
| 27 | 63.3 | 9.5 | 27.2 | 300 | 9.4 | 3 | 395 | sl.pickoff/ sl.build up |
| 28 | 71.4 | 9 | 17.9 | 300 | 9.0 | 3 | | |

The invention has been described in detail with particular reference to certain preferred embodiments thereof, but it will be understood that variations and modifications can be effected within the spirit and scope of the invention.

What is claimed is:

1. A photographic paper comprising a paper sheet with a polyolefin resin layer on each surface of said paper sheet;

a print retaining antistatic layer having a dry coverage of from 10 $mg/m^2$ to 10000 $mg/m^2$ on one of the free surfaces of the polyolefin layers comprising:

a smectite clay; and a polymeric binder selected from the group consisting of poly vinyl alcohols, poly ethylene oxides, polyacrylamides, polystyrene sulfonates, polymers of styrene, polymers of styrene derivatives, interpolymers of styrene, interpolymers of styrene derivatives, alkyl acrylates, alkyl methacrylates, derivatives of alkyl acrylates, derivatives of alkyl methacrylates, olefins, acrylonitriles, polyurethanes and polyester ionomers wherein the polymeric binder(s) can sufficiently intercalate inside or exfoliate said smectite clay.

2. The photographic paper of claim 1, wherein said smectite clay comprises a synthetic hectorite clay.

3. The photographic paper of claim 2, wherein said synthetic hectorite clay comprises a layered hydrous magnesium silicate.

4. The photographic paper of claim 1, wherein said print retaining antistatic layer further comprises a crosslinking agent.

5. The photographic paper of claim 1, wherein said print retaining antistatic layer further comprises a surfactant.

6. The photographic paper of claim 1, wherein smectite clay is present at a dry weight percent of from 20 to 95 and said polymeric binder is present at a weight percent of from 80 to 5.

7. The photographic paper of claim 1 wherein a basal plane spacing of the smectite clay increases by at least 50 percent when the smectite clay:polymeric binder weight ratio is changed from 100:0 to 30:70.

8. The photographic paper of claim 1 further comprising:

a second polymeric binder which does not intercalate inside or exfoliate the smectite clay.

9. The photographic paper of claim 8 wherein the second polymeric binder comprises polyurethane.

10. A photographic paper comprising a paper sheet with a polyolefin resin layer on each surface of said paper sheet;

a print retaining antistatic layer having a dry coverage of from 10 $mg/m^2$ to 10000 $mg/m^2$ on one of the free surfaces of the polyolefin layers comprising:

a smectite clay;

a polymeric binder selected from the group consisting of the poly vinyl alcohols, poly ethylene oxides, polyacrylamides, polystyrene sulfonates, polymers of styrene, polymers of styrene derivatives, interpolymers of styrene, interpolymers of styrene derivatives, alkyl acrylates, alkyl methacrylates, derivatives of alkyl acrylates, derivatives of alkyl methacrylates, olefins, acrylonitriles, plyurethanes and polyester ionomers wherein the polymeric binder can sufficiently intercalate inside or exfoliate said smectite clay; and a silver halide emulsion layer superposed on the other free surface of the polyolefin layer.

11. The photographic paper of claim 10, wherein said smectite clay comprises a synthetic hectorite.

12. The photographic paper of claim 11, wherein said synthetic hectorite clay comprises a layered hydrous magnesium silicate.

13. The photographic paper of claim 10, wherein said print retaining antistatic layer further comprises a crosslinking agent.

14. The photographic paper of claim 10, wherein said print retaining antistatic layer further comprises a surfactant.

15. The photographic paper of claim 10, wherein smectite clay is present at a dry weight percent of from 20 to 95 and said polymeric binder is present at a weight percent of from 80 to 5.

16. The photographic paper of claim 10 wherein the basal plane spacing of the smectite clay increases by at least 50 percent when smectite clay:polymeric binder weight ratio is changed from 100:0 to 30:70.

17. The photographic paper of claim 10 further comprising:

a second polymeric binder which does not intercalate inside or exfoliate the smectite clay.

18. The photographic paper of claim 17 wherein the second polymeric binder comprises polyurethane.

* * * * *